US007366458B2

(12) United States Patent
Ishikawa et al.

(10) Patent No.: US 7,366,458 B2
(45) Date of Patent: Apr. 29, 2008

(54) IMAGE FORMING APPARATUS

(75) Inventors: Tetsuya Ishikawa, Hachioji (JP); Hirotaka Kabashima, Tachikawa (JP); Toru Komatsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/995,150

(22) Filed: Nov. 24, 2004

(65) Prior Publication Data

US 2005/0232669 A1 Oct. 20, 2005

(30) Foreign Application Priority Data

Apr. 19, 2004 (JP) ..... 2004-122670

(51) Int. Cl.
*G03G 21/00* (2006.01)
*G03G 15/08* (2006.01)

(52) U.S. Cl. ..... 399/359; 399/120

(58) Field of Classification Search ..... 399/359, 399/360, 120, 358
See application file for complete search history.

(56) References Cited

U.S. PATENT DOCUMENTS 6,226,490 B1 * 5/2001 Fujita et al. ..... 399/359

* cited by examiner

*Primary Examiner*—David M. Gray
*Assistant Examiner*—Joseph S. Wong
(74) *Attorney, Agent, or Firm*—Finnegan, Henderson, Farabow, Garrett & Dunner, L.L.P.

(57) ABSTRACT

An image forming apparatus for forming a toner image on an image carrier and transferring the toner image to a recording medium including a developing device, cleaning device, first toner conveyer, second toner conveyer, third toner conveyer, and a controller for controlling whether the toner removed by the cleaning device is to be conveyed by the second toner conveyer on the basis of an amount of new toner conveyed to the developing device by the third toner conveyer.

19 Claims, 7 Drawing Sheets

FIG. 6 ( a )
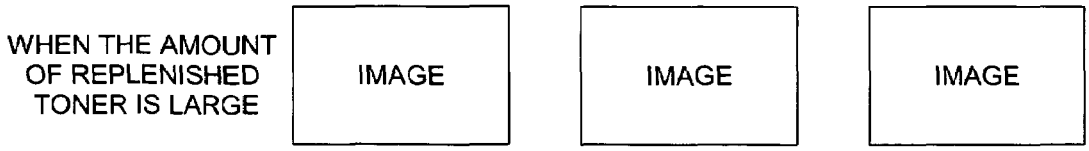
FIG. 6 ( b )
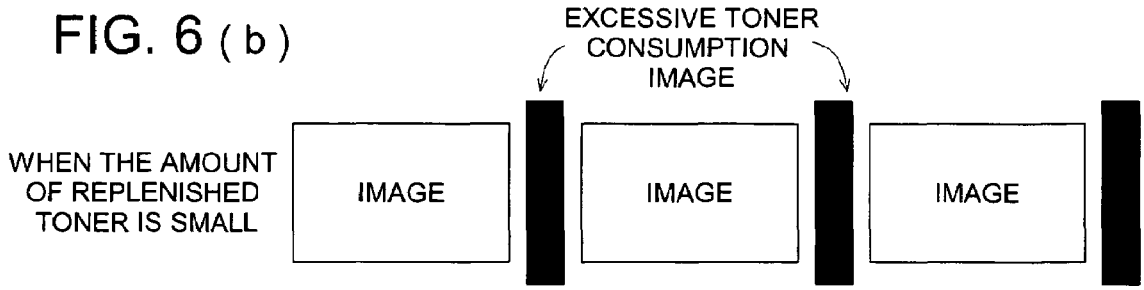

IMAGE FORMING APPARATUS

BACKGROUND OF THE INVENTION

The present invention relates to an image forming apparatus employing an electro-photographic method, and in particular, to an image forming apparatus including a toner recycle mechanism in its developing means.

Recently, in image forming apparatuses employing the electro-photographic method, a toner recycling method is generally used, wherein for the purpose of using toner more effectively, resided toner on an image carrier after the image formation is removed by a cleaning device, and the resided toner (hereinafter referred to also as "recovered toner") is conveyed to the developing means through a feed screw pipe, then the resided toner is used again in the developing process.

In order to repeatedly use recycled toner, concerning the image forming apparatus employing the toner recycling method, incorporated is the toner recycling mechanism by which the recovered toner is returned to the developing device as the developing means, and thereby the condition maintaining predetermined toner density is preserved.

However, when image formation of an area where the number of characters is very low, is greatly performed, very little toner is consumed in the developing device, resulting in an increase of recovered toner at a low transferring ratio, and thereby, very little new toner is supplied from the toner replenishing container.

Under the above described condition, since toner in the developing device, and particularly the recovered toner are agitated in the developing device for a long time, electrostatic charging capability of the toner is largely deteriorated due to stress caused by the agitation.

The deterioration of electrostatic charging capability of toner is outlined below. That is, in order to increase the electrostatic charging capability of toner, while toner is produced, silica is added to cover the surface of toner which increases the flow-ability of the toner. However, silica is stressed during agitation in the developing device, then silica is separated from toner or buried in toner resin, and the deterioration of electrostatic charging capability of toner results.

When toner exhibits the deteriorated electrostatic charging capability, the image transferring efficiency is reduced, resulting in a poor formation of the image, such as roughened images.

In order to prevent poor formation of images, in the image forming apparatus employing the toner recycling method, a method is disclosed wherein the recovered toner is discarded from the toner recycling path which circulates toner to the developing device, based on the developing condition.

For example, in the image forming apparatus, disclosed are:

a technology wherein when a main switch is turned on, or when a copy operation is started after a predetermined period of the non-operation, the apparatus mode is changed to one which discards the toner recovered during a definite period of time;

a technology wherein the density of resided toner on the surface of image carrier is detected as a predetermined value, and the apparatus mode is changed to discard the recovered toner (see Patent Document 1); and a technology wherein when a temperature value detected by a thermo sensor is greater than a predetermined temperature value, the apparatus mode is changed to discard the toner recovered based on the fact that a double sided copy has been conducted, as well as the operation time of the double sided copy (see Patent Document 2).

Patent Document 1: Japanese Patent No. 3204076

Patent Document 2: Japanese Laid-Open Patent Publication No. 2003-150016

However, the object of the above technologies is to prevent poor formation of images due to deterioration of the toner characteristic caused by excessive heat. The method for changing the apparatus mode based on the resided toner in the transferring process is to measure the resided toner on the image carrier by the image density sensor. However it is very difficult to exactly measure the residual toner on the image carrier in the transferring process, because the measurement is greatly dependent upon the relationship between the outputted image and the sensor position.

SUMMARY OF THE INVENTION

The object of the present invention is to provide an image forming apparatus, wherein investigated is the amount of toner supplied to the developing device, the consumed amount of toner can be exactly measured, the stress added to toner is greatly reduced, and any roughened image caused by an insufficient electrostatic charging can be prevented.

The object of the present invention will be attained by the structures described below.

Structure 1

An image forming apparatus for forming a toner image on an image carrier and transferring the toner image to a recording medium, including:

a developing device for forming toner image on the image carrier, a cleaning device for removing toner residing on the image carrier not being transferred to the recording medium, a first toner conveyer for conveying toner removed by the cleaning device to the developing device as recycled toner, a second toner conveyer for conveying toner removed by the cleaning device to a disposal container, a third toner conveyer for conveying toner at least containing new toner to the developing device, and a controller for controlling whether the toner removed by the cleaning device is to be conveyed by the second toner conveyer on the basis of an amount of new toner conveyed to the developing device by the third toner conveyer.

Structure 2

An image forming apparatus for forming a toner image on an image carrier and transferring the toner image to a recording medium, including:

a developing device for forming toner image on the image carrier, a cleaning device for removing toner residing on the image carrier not being transferred to the recording medium, a toner recycling section for returning toner removed by the cleaning device to the developing device as recycled toner, a toner disposing section for disposing toner removed by the cleaning device to a disposal container, and a controller for controlling whether the toner removed by the cleaning device is to be recycled by the toner recycling section or to be disposed by the toner disposing section on the basis of an amount of new toner supplied to the developing device.

BRIEF DESCRIPTION OF THE DRAWINGS

FIG. 6 shows a pattern image which is formed on the periphery of the image forming area for the transfer material on the image carrier.

DETAILED DESCRIPTION OF THE PREFERRED EMBODIMENT

The image forming apparatus of the present invention will be detailed below.

Figure 1:
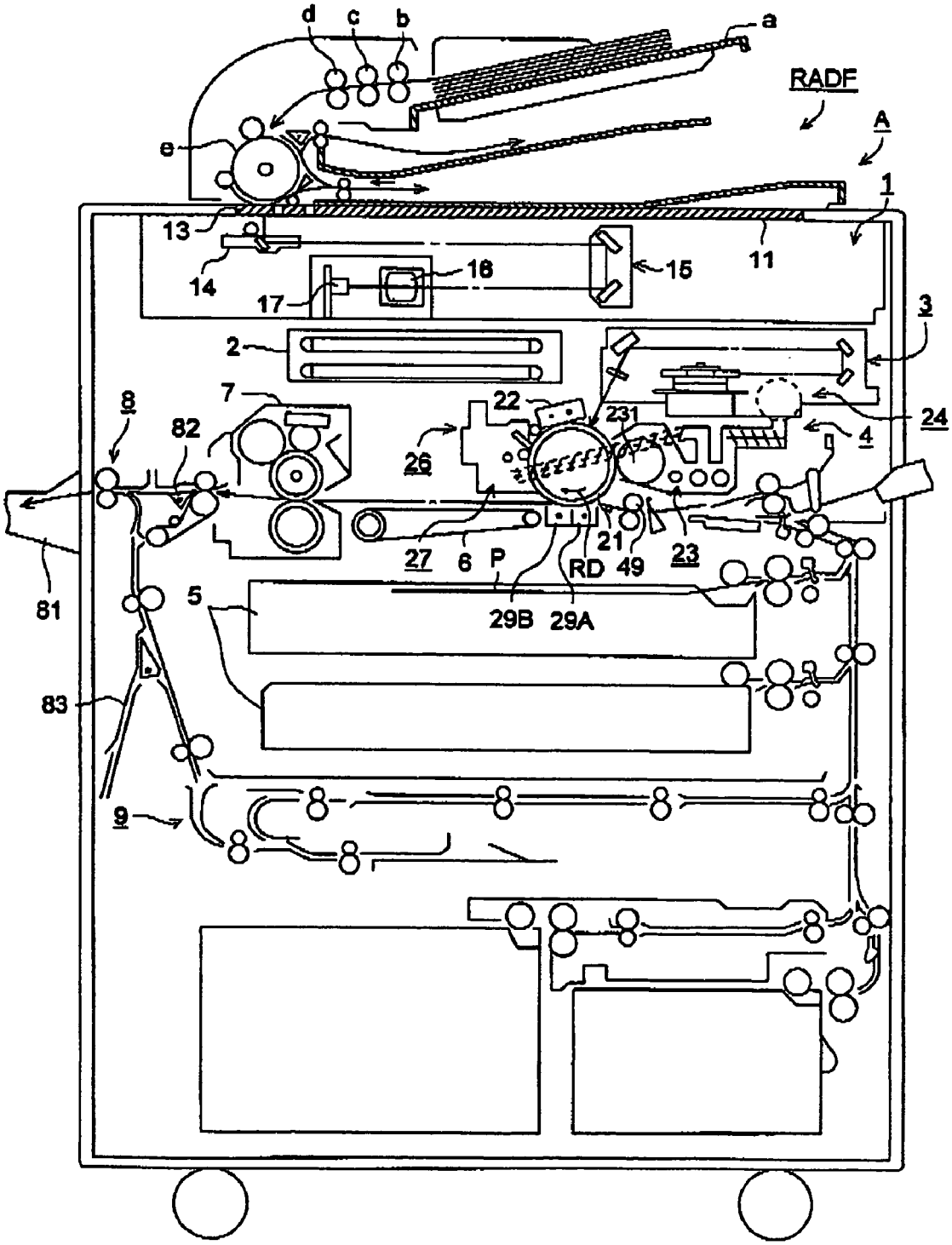
FIG. 1 shows a total structure of an image forming apparatus.

FIG. 1 shows the total structure of the image forming apparatus.

In FIG. 1, the image forming apparatus incorporates double surface document automatic feeding device RADF, as well as main image forming apparatus "A".

Double surface document automatic feeding device RADF, being able to be opened or closed, is located on main image forming apparatus "A". A document sheet set on document supply stand "a", is conveyed through sheet supply rollers "b", separation rollers "c", registration rollers "d", and feeding drum "e".

Main image forming apparatus "A" incorporates image reading device 1, image processing means 2, image writing device 3, image forming means 4, sheet supplying cassette 5, conveyance means 6, fixing device 7, sheet ejection means 8, and re-conveyance means 9.

An optical system of image reading device 1 incorporates exposure unit 14 including a light source and a first mirror, V mirror unit 15 including a second mirror and a third mirror, lens 16, and CCD image sensor 17. Reading out of the document by double surface document automatic feeding device RADF is performed, when exposure unit 14 stops and is positioned at an initial position located under slit exposure glass 13. Reading of document on document stand glass 11 is performed, while exposure unit 14 and V mirror unit 15 are moved.

Image information of the document image read by image reading device 1 is conducted with respect to the image process by image processing means 2, after which image information is converted to image data signal, and is stored in a memory. Based on the stored image data, the light rays generated by a semiconductor laser, which is included in image writing means 3, but not illustrated, are radiated onto image carrier 21 as an image carrier, and consequently, an electrostatic latent image is generated.

In image forming means 4, charging device 22 delivers electric charges onto image carrier 21, electrostatic latent images are generated via the laser rays from image writing means 3, and developing roller 231 of developing device 23 as a developing means develops the electrostatic latent images, which become visible as a toner image.

The toner images are transferred by transfer electrode 29A, onto sheet P, used as a transfer material which is conveyed from sheet supply cassette 5, after which sheet P is exfoliated by separating electrode 29B, and the residual toner on the image carrier is removed by cleaning device 26. Then, sheet P, carrying the toner image, is conveyed to fixing device 7 by conveyance means 6, and sheet P is fixed by fixing device 7. Next, sheet P is ejected by sheet ejecting means 8 to sheet receiving tray 81, attached outside the apparatus.

In the case of double surface image formation, sheet P carrying the images on its front surface (being the first surface) is conveyed to re-conveyance means 9 by conveyance path changing plate 82, next, sheet P is again conveyed to image forming means 4, where another image is formed on the reverse surface (being the second surface) of sheet P, after which sheet P is ejected onto sheet receiving tray 81, attached outside the apparatus, by sheet ejecting means 8. In the case of reversed sheet ejection, sheet P branches out from the normal ejecting path by conveyance path changing plate 82. After sheet P is reversed, with respect to its two surfaces in a switch back manner, in reversing ejection section 83, sheet P is ejected onto sheet receiving tray 81, attached outside the apparatus, by sheet ejecting means 8.

Next, the conveyance of recycled toner will be detailed.

In the case of the image forming apparatus employing the toner recycling function, in order to prevent toner from being excessively agitated in the developing device over a long time period, new toner to be supplied to the toner circulation system including the developing device, as well as toner which was used on the transfer sheet and ejected outside the apparatus, it is necessary to reserve the amounts of each toner which are greater than the predetermined amounts.

The replenishing amount of toner to the developing device is determined based on the detected density value measured on a standard pattern which is formed in a non-image portion of the print, or on the detected magnetic permeability value of the developer, so that the toner density in the developing device can be maintained at a predetermined value. Additionally the magnetic permeability is detected by magnetic permeability sensor 232.

Figure 2:
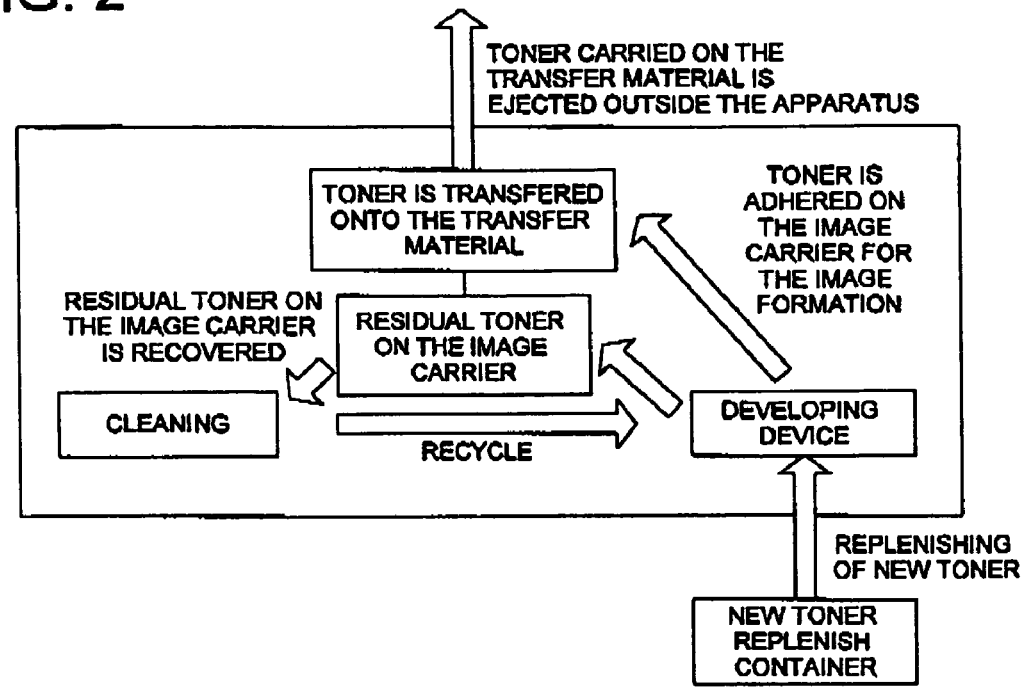
FIG. 2 shows the structure of a toner recycling system.

FIG. 2 shows the structure of the toner recycling system.

In FIG. 2, new toner, supplied from the new toner replenishing container to the developing device, is agitated and applied onto the photoconductive drum, and then transferred onto the transfer material. Toner residing on the photoconductive drum is removed by the cleaning device, and returned to the developing device as recovered toner.

In a conventional recycling system, employed is a method wherein the total amount of toner removed by the cleaning device is recycled to the developing device.

The First Embodiment

Figure 3:
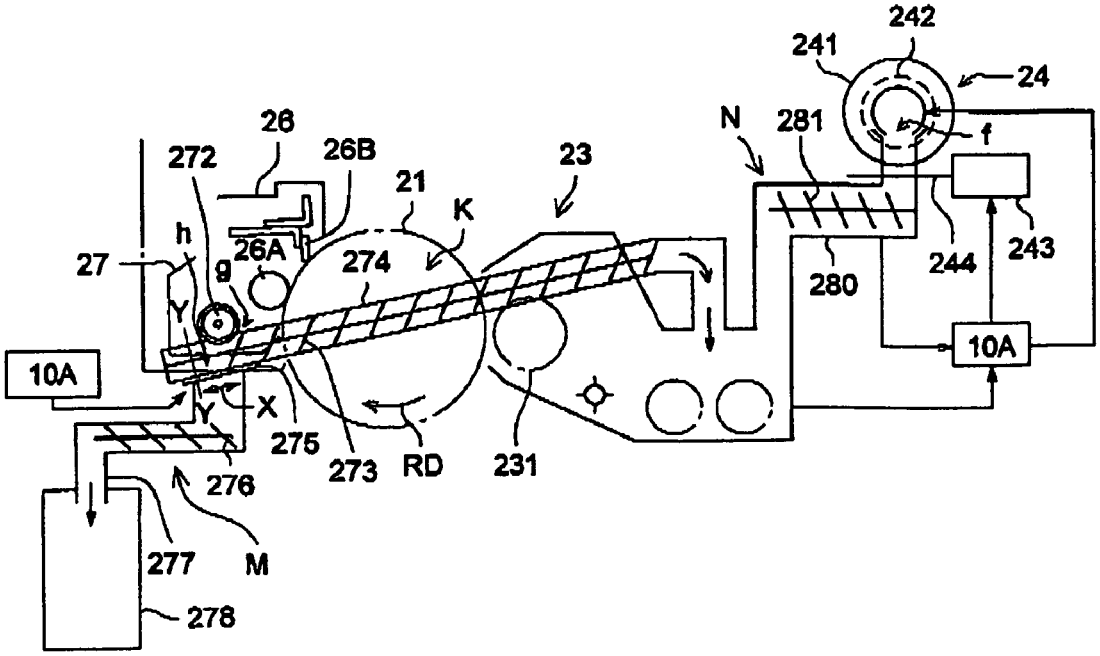
FIG. 3 is an enlarged sectional drawing of the area of the photoconductor drum (hereinafter referred to as an image carrier) shown in FIG. 1 of the first embodiment.

FIG. 3 is an enlarged sectional drawing of the recycling section of the area of the photoconductive drum shown in FIG. 1 of the first embodiment.

Figure 4:
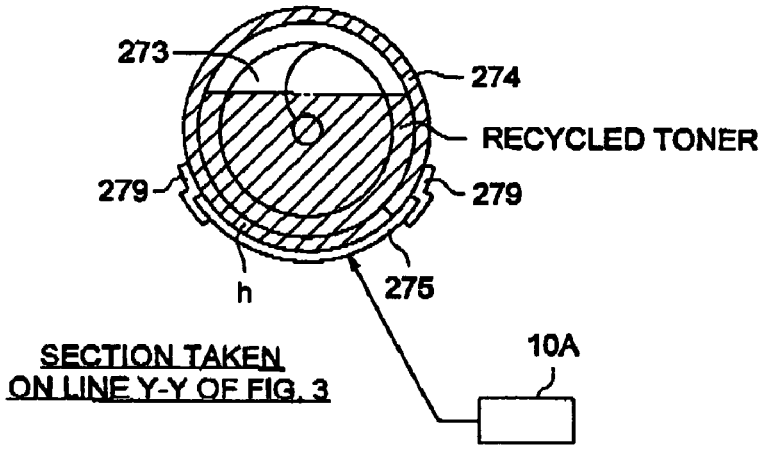
FIG. 4 is a sectional drawing of a disposal outlet of a recycling pipe relating to the present invention.

FIG. 4 is a sectional drawing of the outlet of the recycling pipe relating to the present invention.

In FIG. 3, residual toner on image carrier 21 is removed by cleaning blade 26B arranged downstream of image carrier 21 with respect to the rotating direction (RD) of image carrier 21. Next, removed toner is directed to recycled toner container 27 by guiding roller 26A, then, conveyed by feed screw 272, and contained in recycled toner container 27. Next, removed toner is conveyed by feed screw 272 to opening section "g" disposed on recycling pipe 274 of first toner conveyer K, then sent back to developing device 23 by feed screw 273 through recycling pipe 274, and is then reused. In this case, screw 272 and feed screw 273 are rotated by a driving mechanism which is not illustrated.

Disposal outlet "h" is located in recycling pipe 274 structured in first toner conveyer K. Disposal outlet "h" is opened or closed, as occasion demands, by shutter 275 as a changing section movable in the X direction along guide 279 (see FIG. 4) by a driving solenoid which is not illustrated, based on the command signals from controller 10A. When shutter 275 moves to open disposal outlet "h", the removed toner is not sent to developing device 23, but channeled to disposal container 278 through disposal pipe 277 and feed screw 276, both of which are included in second toner conveyer M.

On the other hand, new toner replenishing container 241, containing new toner, is rotated by agitation means 242, driven by a power source which is not illustrated. Then passing through toner replenish outlet "f", new toner is supplied from new toner replenishing container 241 to developing device 23 through replenish pipe 280 and feed screw 281 included in third toner conveyer N.

That is, by the rotation of new toner replenishing container 241 including a helical conveyance groove, new toner is agitated and conveyed so that new toner is ejected from new toner replenishing container 241 through toner outlet "f". Further, toner conveying/stopping means 243 controls a conveyance/stoppage operation of new toner from new toner replenishing container 241 toward developing device 23. In the present embodiment, shutter 244 is employed for the conveyance/stoppage operation of new toner, however, shutter 244 is not limited for this means.

Still further, even in a mode other than the mode of conveying toner from toner replenish device 24 toward developing device 23, controller 10A controls agitation of toner in new toner replenishing container 241, by setting the stoppage condition of toner conveyance through toner conveying/stopping means 243.

It is very difficult to measure the actual replenishing amount of new toner fed to developing device 23, in gram units, therefore, the apparatus obtains the number of rotations of feed screw 281 from the total operation period of third toner conveyer N, and then calculates a toner conveyance amount corresponding to the number of rotations of feed screw 281, which is the replenish amount of new toner.

Figure 8:
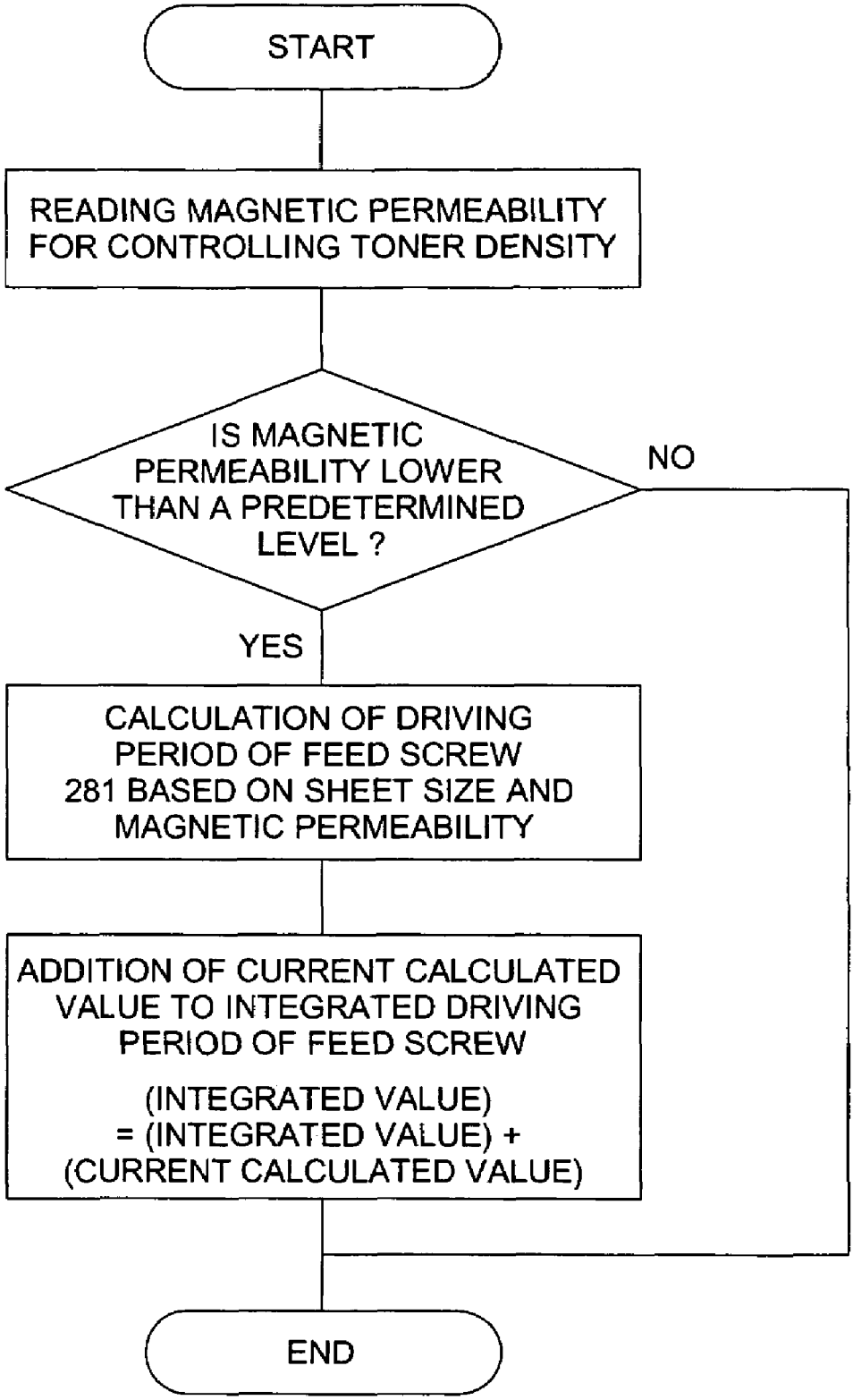
FIG. 8 is a flow chart of the process wherein after magnetic permeability of toner is read, the integrated driving period of feed screw 281 is determined.

The integrated driving period of developing device 23 as well as the integrated driving period of third toner conveyer N, corresponding to the amount of new toner supplied from toner replenish device 24, is measured by a time measuring device which is not illustrated, and inputted to controller 10A. The above-described procedure is shown in FIG. 8.

As described above, when toner is agitated for a long time in the developing device, the resulting stress causes deterioration of electrostatic charging capability. In order to prevent this problem, concerning new toner to be supplied to a toner circulation system centering the developing device, as well as toner which was used on the transfer sheet and ejected outside the apparatus, it is necessary to reserve the amounts of each toner which are greater than the predetermined amounts.

In the structure wherein toner removed by cleaning device 26 is directly returned to the developing device, when a large number of images at a low image printing ratio are outputted, or when the transferring efficiency is reduced, the amount of toner as the image prints, ejected outside the apparatus, is reduced, but the toner density is not reduced. Accordingly, the amount of new toner replenished to the developing device is reduced.

Figure 9:
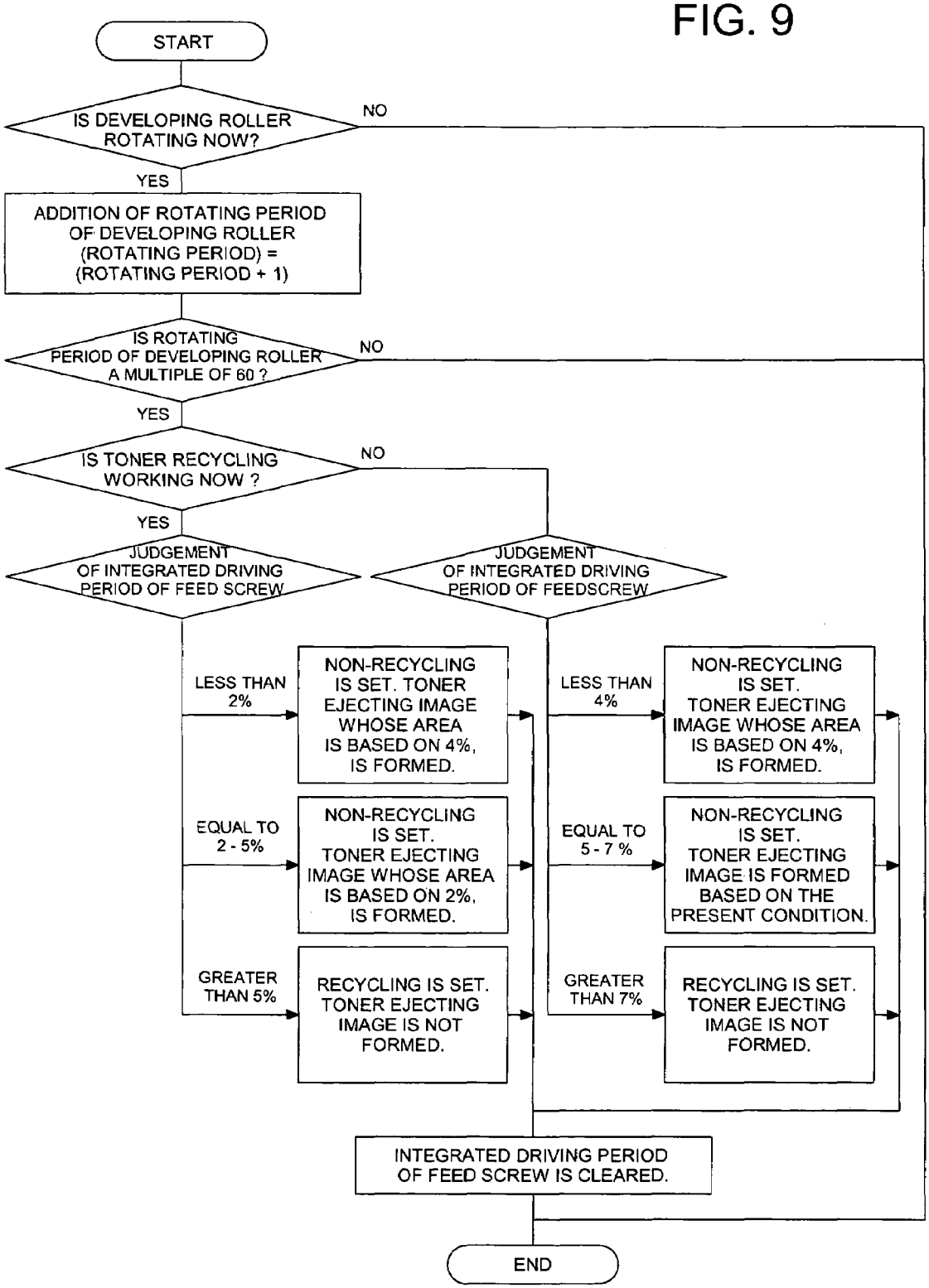
FIG. 9 is a flow chart for determining the size of excessive toner consumption image, based on the toner recycling process or the toner non-recycling process.

Therefore, in the first embodiment of the present invention, based on an amount of new toner supplied to the developing device 23 in the integrated driving period of driving device 23 through the third toner conveyer N, the recycled toner is conveyed or stopped by shutter 275 as a changing section, and thereby an amount greater than a predetermined amount of new toner is assured, and the amount of recycled toner in developing device 23 is controlled to be less than the predetermined amount. The above-described procedure is shown in FIG. 9.

The Second Embodiment

Next, the recycling structure of the second embodiment of the present invention will be explained.

Figure 5:
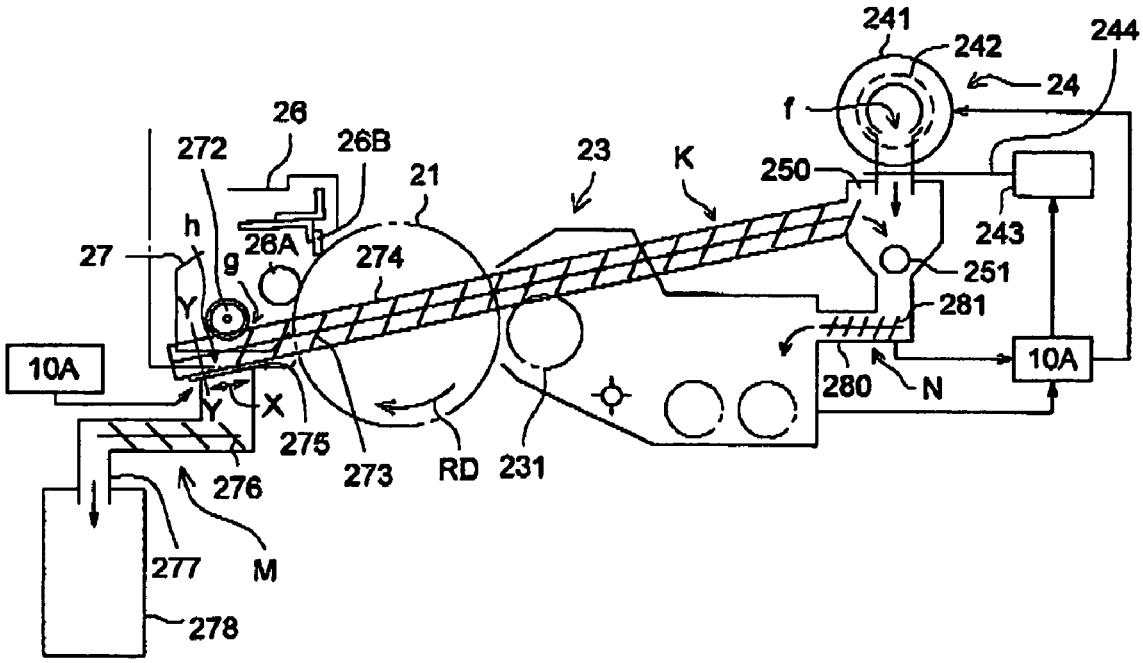
FIG. 5 shows a recycling structure of the second embodiment.
Figure 7:
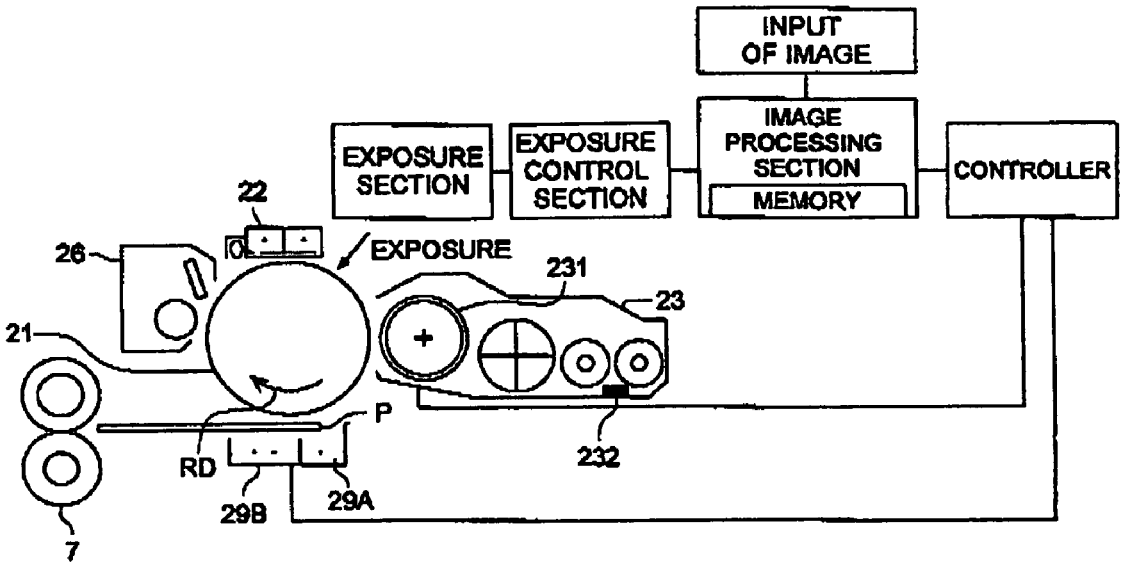
FIG. 7 shows the position of toner permeability sensor 232 in the developing device 23.

FIG. 5 shows the recycling structure of the second embodiment.

In FIG. 5, numeral 250 shows a toner hopper, which is a space for mixing recycled toner and new toner.

In the present recycling structure, residual toner on image carrier 21 is removed by cleaning blade 26B located downstream of image carrier 21, with respect to the rotating direction (RD) of image carrier 21. Next, removed toner is directed to recycled toner container 27 by guide roller 26A, then, conveyed by feed screw 272, and stored in recycled toner container 27. Next, removed toner is conveyed by feed screw 272 to open section "g" located on recycling pipe 274 of first toner conveyer K, then sent to toner hopper 250 by feed screw 273 through recycling pipe 274, and stored for the reuse. In this case, screw 272 and feed screw 273 are rotated by a driving mechanism which is not illustrated.

Disposal outlet "h" is formed in recycling pipe 274 structured in first toner conveyer K. Toner disposal outlet "h" is opened or closed as occasion demands by shutter 275 as a changing section moving in direction X along guide 279 (see FIG. 4) by a driving solenoid which is not illustrated, based on command signals from controller 10A. When shutter 275 opens toner disposal outlet "h", the toner is not sent to toner hopper 250, but sent to toner disposal container 278 through toner disposal pipe 277 and feed screw 276, both of which are included in second toner conveyer M.

On the other hand, new toner replenishing container 241 containing new toner is rotated by agitation means 242, driven by a power source which is not illustrated, and thereby new agitated toner falls into toner hopper 250 through toner replenish outlet "f". Recycled toner and new toner are mixed in toner hopper 250, after which they are supplied to developing device 23 by feed screw 281 through replenish pipe 280.

Concerning the replenishing process of new toner from toner replenishing container 241, by rotation of new toner replenishing container 241 incorporating a helical conveyance groove, new toner is agitated and conveyed so that new toner is fed from new toner replenishing container 241 through toner outlet "f". Further, new toner conveying/stopping means 243 controls a conveyance/stoppage operation of new toner from new toner replenishing container 241 toward developing device 23. In the present embodiment, shutter 244 is employed for the conveyance/stoppage operation of new toner, however, shutter 244 is not limited for this means. Still further, in a mode other than conveying toner from toner hopper 250 into developing device 23, controller 10A can also control agitating member 251 to mix toner in new toner replenishing container 241, by setting the stoppage condition of toner conveyance by new toner conveying/stopping means 243.

Additionally, toner hopper 250, first toner conveyer K, third toner conveyer N and shutter 275 represent a toner recycling section.

For measuring the replenishing amount of new toner or mixed toner to developing device 23, it is very difficult to measure the actual replenishing amount (in grams), therefore, the apparatus obtains the number of rotations of feed screw 281 from the operation period of third toner conveyer N, and then calculates the toner conveyance amount corresponding to the number of rotations of feed screw 281, which is calculated to the replenishing amount of toner.

The integrated driving period of developing device 23 and the integrated amount of mixed toner replenished from toner hopper 250 are measured by a time measuring device which is not illustrated, and inputted to controller 10A so that they are converted to the amount of toner.

An image output of 5% as a printed image area ratio, employing A4 size sheets, is generally set as a standard condition for the image forming apparatus. The standard consumption of toner is measured and determined based on the above standard. When the replenished toner amount is lower than the amount corresponding to 5% of the printed image area ratio, recycling operation is stopped (that is, disposal outlet "h" is opened by shutter 275). Therefore, prevented is not only the poor formation of image, caused by toner subjected to too much physical stress, but also frequent changing of toner replenishing container, due to excessive disposal of toner.

Recycled toner sent from recycled toner container 27 is sent by feed screw 273, and stored in toner hopper 250. Further, new toner replenished from new toner replenishing container 241 is also supplied to toner hopper 250, where recycled toner and new toner are mixed and stored.

In addition, new toner is agitated and conveyed by agitating means 242 which is connected to a driving source, not illustrated, then ejected from toner outlet "f" into toner hopper 250. The description of the controls of new toner conveying/stopping means 243 and shutter 244 as a changing means are omitted, because they are the same as those explained employing FIG. 3.

In the present recycling structure, mixture of new toner and recycled toner, mixed in toner hopper 250, is conveyed to developing device 23 through replenish pipe 280 and feed screw 281 both of which are incorporated in third toner conveyer N.

In conclusion, the second embodiment is characterized in that changing section 244 is switched based on an amount of new toner and recycled toner which are replenished to developing device 23 through third toner conveyer N, in the integrated driving period of the developing means.

Further, not only in the first embodiment but also in the second embodiment, whether toner recycling is to be performed or not is determined based on the amount of toner supplied to the developing device (that is, the amount of toner consumed in the developing device for image formation). Accordingly, even when the printed image area ratio or the transfer efficiency is very low, the apparatus can easily eject toner outside the apparatus, and thereby can prevent the generation of image roughness. When the printed image area ratio or the transfer efficiency is high, by performing toner recycling, an environment-conscious operation is performed, and further, toner consumption is reduced. In this case, the image roughness means an area having no image is happened due to wrong transferring onto the recording material. The image roughness occurs when the electrostatic charging amount is reduced by an excessive agitation.

Assumed is that:

the predetermined period in which the developing device operates is "X" (in minutes), the image size is an A4 sheet, the consumed amount of toner is "Y" (in gram/minute), when the image having the printed image area ratio of 5% is outputted, and the integrated amount of toner conveyed from third toner conveyer N in predetermined period "X" (in minutes) is "Z" (in grams), when "Z" is smaller than (X×Y), it is preferable that the apparatus shuts off toner recycling.

As described above, the apparatus includes the function wherein a section for changing conveyance or stoppage operation of toner is switched based on the integrated amount of toner replenished to the developing device in the integrated driving period of the developing means through third toner conveyer N. Further the apparatus includes the function wherein the image for ejecting toner is formed on the area of non-image formation on the image carrier, and additionally changes the size of the image for ejecting excess toner, even when the printed image area ratio is very low. Accordingly, excess toner can be effectively fed outside the apparatus.

FIG. 6, shows a pattern image formed on the area of non-image formation on the image carrier.

In FIG. 6, when replenished amount of toner is relatively great, that is, when the printed image area ratio is greater than the standard value, since toner subjected to the physical stress can be consumed in the image area, there is no need to form a excessive toner consumption image (being a pattern for consuming the excess toner) on the areas of non-image formation on the image carrier, shown in FIG. 6(*a*). On the other hand, when toner consumption is small, that is, when the printed image area ratio is smaller than the standard value, it is possible to form a excessive toner consumption image whose size can be changed for optimal toner consumption on areas of non-image formation on the image carrier, as shown in FIG. 6(*b*). Accordingly, it is always possible to eject a predetermined optimal amount of toner to the outside of the apparatus.

It is preferable that the size of the excessive toner consumption image is set referring to the amount of replenished toner, and to meet the conditions of (Z=X×Y).

Accordingly toner subjected to the physical stress is prevented from remaining in the developing device for an excessive time, and thereby, unacceptable formation of images due to lack of electrostatic charging capability can be prevented.

The desired effects described above were confirmed by the experiments described below.

In the experiments, employed are conventional recycling structures and the recycling structures of the present invention. The printing process was repeated for 2,000 sheets with respect to a document including the printed image area ration of 1-5%, and the visual observation for the roughness of image was performed on each half tone image for each $2000^{th}$ print.

Table 1 shows the experimental conditions.

TABLE 1

| | Experiment No. | Toner hopper | Recycling of toner | Excessive toner consumption image |
|---|---|---|---|---|
| Comparative example | 1 | Not provided | All recycled, no ejection | Not formed |
| | 2 | provided | All recycled, no ejection | Not formed |
| | 3 | Not provided | Periodical ejection (*1) | Not formed |
| | 4 | Provided | Periodical ejection | Not formed |
| Present invention | 5 | Not provided | Integral amount method (*2) | Not formed |
| | 6 | provided | Integral amount method | Not formed |
| | 7 | Not provided | Integral amount method | Formed |
| | 8 | provided | Integral amount method | Formed |

Note *1:
Recycling was stopped for a run of 100 copies, with respect to each 1000 copies, after which recycling was continued (Toner ejection is periodically performed).
Note *2:
The amount of toner replenished to the developing device was calculated with respect to each minute of the integrated driving period of the developing roller. When the calculated amount was less than the amount of toner consumed for a printed image area ratio of 5%, recycling was stopped. Additionally, in the image forming apparatus employed for the present invention, when an image having a printed image area ratio of 5% on A4 sized sheets, is repeatedly printed, the amount of toner consumption is 3.3 gram/minute, and thereby a threshold value for determining the recycling operation was set to 3.3 gram.

EXPERIMENTAL RESULT

[Experiment 1]

Table 2 shows the result of experiment 1. Concerning the document having 1-4% of the printed image ratio, the image roughness is observed.

TABLE 2

| Number of prints | Printed image area ratio 1% | 2% | 3% | 4% | 5% |
|---|---|---|---|---|---|
| 0 | G(*3) | G | G | G | G |
| 2000 | G | G | G | G | G |
| 4000 | G | G | G | G | G |
| 6000 | W(*4) | W | G | G | G |
| 8000 | W | W | W | G | G |
| 10000 | W | W | W | W | G |

Note *3:
"G" means that image roughness cannot be observed.
Note *4:
"W" means that image roughness is observed.

[Experiment 2]

Table 3 shows the result of experiment 2.

Concerning the document having 1-4% of the printed image ratio, the image roughness was observed, independently of the recycling structure.

TABLE 3

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | W | W | G | G | G |
| 8000 | W | W | W | G | G |
| 10000 | W | W | W | W | G |

[Experiment 3]

Table 4 shows the result of experiment 3. The number of prints having the image roughness was improved, but not effective.

TABLE 4

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | G | G | G | G | G |
| 8000 | W | W | G | G | G |
| 10000 | W | W | W | G | G |

[Experiment 4]

Table 5 shows the result of experiment 4. The number of prints having the image roughness was improved, but not effective.

TABLE 5

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | G | G | G | G | G |
| 8000 | W | W | G | G | G |
| 10000 | W | W | W | G | G |

[Experiment 5]

Table 6 shows the result of experiment 5. Though the image roughness was observed on the document having the image print area ratio of 1-2%, the acceptable number of prints was increased.

TABLE 6

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | G | G | G | G | G |
| 8000 | G | G | G | G | G |
| 10000 | W | W | G | G | G |

[Experiment 6]

Table 7 shows the result of experiment 6. Though the image roughness was observed on the document having the image print area ratio of 1-2%, the acceptable number of prints was increased.

TABLE 7

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | G | G | G | G | G |
| 8000 | G | G | G | G | G |
| 10000 | W | W | G | G | G |

[Experiment 7]

Table 8 shows the result of experiment 7. The image roughness was not observed, because toner corresponding to the image print area ratio of 5% was always ejected outside the apparatus, without returning to the developing device 23.

TABLE 8

| Number of prints | Printed image area ratio 1% | 2% | 3% | 4% | 5% |
|---|---|---|---|---|---|
| 0 | G | G | G | G | G |
| 2000 | G | G | G | G | G |
| 4000 | G | G | G | G | G |
| 6000 | G | G | G | G | G |
| 8000 | G | G | G | G | G |
| 10000 | G | G | G | G | G |

[Experiment 8]

Table 9 shows the result of experiment 8. The image roughness was not observed, because toner corresponding to the image print area ratio of 5% was always ejected to the outside of the apparatus, without returning to the developing device 23.

TABLE 9

| Number of prints | Printed image area ratio 1% | 2% | 3% | 4% | 5% |
|---|---|---|---|---|---|
| 0 | G | G | G | G | G |
| 2000 | G | G | G | G | G |

TABLE 9-continued

| Number of prints | Printed image area ratio 1% | 2% | 3% | 4% | 5% |
|---|---|---|---|---|---|
| 4000 | G | G | G | G | G |
| 6000 | G | G | G | G | G |
| 8000 | G | G | G | G | G |
| 10000 | G | G | G | G | G |

Judging from the experimental results described above, since changing of replenishment or non-replenishment of the recovered toner to the developing device is conducted based on an integrated amount of new toner supplied to the developing device in an predetermined driving period of the developing device, the stress on the toner (being a developer) by the extended agitation in the developing device, is controlled, and thereby preventing poor formation of images, such as roughened images, caused by the deterioration of the electrostatic charging capability.

What is claimed is:

1. An image forming apparatus for forming a toner image on an image carrier and transferring the toner image to a recording medium, comprising;

a developing device for forming toner image on the image carrier, a cleaning device for removing toner residing on the image carrier not being transferred to the recording medium, a first toner conveyer for conveying toner removed by the cleaning device to the developing device as recycled toner, a second toner conveyer for conveying toner removed by the cleaning device to a disposal container, a third toner conveyer for conveying toner at least containing new toner to the developing device, and a controller for controlling the second toner conveyer to dispose the toner removed by the cleaning device to the disposal container, when $$Z<(X\times Y)$$

where

"X" means a predetermined period (in minutes) for driving the developing device, "Y" means an amount (in gram/min) of toner consumed during a unit time on a transfer material, and "Z" means an amount (in grams) of toner conveyed by the third toner conveyer during the predetermined period "X" (in minutes).

2. The image forming apparatus of claim 1, wherein an excessive toner consumption image is formed outside an area for a transfer material on the image carrier.

3. The image forming apparatus of claim 2, wherein the size of excessive toner consumption image is controlled based of the amount of new toner supplied to the developing device by the third toner conveyer.

4. The image forming apparatus of claim 1, wherein the controller controls the second toner conveyer to dispose the toner removed by the cleaning device to the disposal container on the basis of a ratio of the integrated driving period of the developing device and the integrated driving period of the third toner conveyer during the predetermined period X.

5. The image forming apparatus of claim 1, further comprising a changing section for changing whether the toner removed by the cleaning device is to be conveyed by the first toner conveyer or to be conveyed by the second conveyer, wherein the controller controls the changing section on the basis of the amount of new toner supplied to the developing device.

6. The image forming apparatus of claim 1, wherein the first toner conveyer directly conveys the toner removed by the cleaning device to the developing device.

7. The image forming apparatus of claim 1, further comprising:

a toner hopper for mixing the recycled toner and the new toner supplied from a new toner replenishing container, wherein the first toner conveyer conveys the recycled toner to the toner hopper, and the third toner conveyer conveys the mixed toner including the recycled toner and the new toner to the developing device.

8. The image forming apparatus of claim 1, wherein the amount of new toner supplied to the developing device by the third toner conveyer is calculated based on the driving period of the third toner conveyer.

9. The image forming apparatus of claim 1, wherein the third toner conveyer includes a feed screw for conveying toner, and the amount of new toner supplied to the developing device by the third toner conveyer is calculated corresponding to the rotation number of the feed screw.

10. An image forming apparatus for forming a toner image on an image carrier and transferring the toner image to a recording medium, comprising:

a developing device for forming toner image on the image carrier, a cleaning device for removing toner residing on the image carrier not being transferred to the recording medium, a toner recycling section for returning toner removed by the cleaning device to the developing device as recycled toner, a toner disposing section for disposing toner removed by the cleaning device to a disposal container, a toner conveying section for conveying toner at least containing new toner to the developing device; and a controller for controlling the toner disposing section to dispose the toner removed by the cleaning device when $$Z<(X\times Y)$$

where

"X" means a predetermined, period (in minutes) for driving the developing device, "Y" means an amount (in gram/min) of toner consumed during a unit time on a transfer material, and "Z" means an amount (in grams) of toner conveyed by the toner conveying section during the predetermined period "X" (in minutes).

11. The image forming apparatus of claim 10, wherein an excessive toner consumption image is formed outside an area for a transfer material on the image carrier.

12. The image forming apparatus of claim 11, wherein the size of excessive toner consumption image is controlled based of the amount of new toner supplied to the developing device by the toner conveying section.

13. The image forming apparatus of claim 10, wherein the controller controls the toner disposing section to dispose the toner removed by the cleaning device to the disposal container on the basis of a ratio of the integrated driving period of the developing device and the integrated driving period of the toner conveying section during predetermined period X.

14. The image forming apparatus of claim 10, further comprising a changing section for changing whether the toner removed by the cleaning device is to be conveyed by the toner recycling section or to be conveyed by the toner disposing section, wherein the controller controls the changing section on the basis of the amount of new toner supplied to the developing device.

15. The image forming apparatus of claim 10, wherein the toner recycling section directly conveys the toner removed by the cleaning device to the developing device.

16. The image forming apparatus of claim 10, further comprising:

a toner hopper for mixing the recycled toner and the new toner supplied from a new toner replenishing container, wherein the toner recycling section conveys the recycled toner to the toner hopper, and the toner conveying section conveys the mixed toner including the recycled toner and the new toner to the developing device.

17. The image forming apparatus of claim 10, wherein the amount of new toner supplied to the developing device by the toner conveying section is calculated based on the driving period of the toner conveying section.

18. The image forming apparatus of claim 10, wherein the toner conveying section includes a feed screw for conveying toner, and the amount of new toner supplied to the developing device by the toner conveying section is calculated based on the rotation number of the feed screw.

19. An image forming apparatus, for forming a toner image on an image carrier and transferring the toner image to a recording medium, comprising;

a developing device for forming toner image on the image carrier, a cleaning device for removing toner residing on the image carrier not being transferred to the recording medium, a first toner conveyer for conveying toner removed by the cleaning device to the developing device as recycled toner, a second toner conveyer for conveying toner removed by the cleaning device to a disposal container, a third toner conveyer for conveying toner at least containing new toner to the developing device, and a controller for controlling the second toner conveyer to dispose the toner removed by the cleaning device to the disposal container, wherein the controller controls the second toner conveyer to dispose the toner removed by the cleaning device to the disposal container, when $$Z<(X\times Y),$$

where:

"X" means a predetermined period (in minutes) for driving the developing device, "Y" means an amount (in gram/min) of toner consumed during a unit time on a transfer material when image carrying a printed image area ratio of 5% is outputted at a maximum image forming speed for A4 size on the image forming apparatus, and "Z" means an amount (in grams) of toner conveyed by the third toner conveyer during the predetermined period "x" (in minutes).

* * * * *